US005967853A

United States Patent [19]

Hashim

[11] Patent Number: 5,967,853

[45] Date of Patent: Oct. 19, 1999

[54] CROSSTALK COMPENSATION FOR ELECTRICAL CONNECTORS

[75] Inventor: Amid I. Hashim, Randolph, N.J.

[73] Assignee: Lucent Technologies Inc., Murray Hill, N.J.

[21] Appl. No.: 08/881,230

[22] Filed: Jun. 24, 1997

[51] Int. Cl.[6] ..... H01R 23/02

[52] U.S. Cl. ..... 439/676; 439/941

[58] Field of Search ..... 439/676, 941, 439/620, 76.1

[56] References Cited

U.S. PATENT DOCUMENTS 5,459,643 10/1995 Siemon et al. ..... 439/941

5,697,817 12/1997 Bouchan et al. ..... 439/676

5,700,167 12/1997 Pharney et al. ..... 439/941 X 5,716,237 2/1998 Conorich et al. ..... 439/660

*Primary Examiner*—Khiem Nguyen

[57] ABSTRACT

Crosstalk compensation is achieved by connecting coupling devices (e.g., capacitors) between different pairs of conductors of a multi-pair connector. The coupling devices are selected to offset both differential-to-differential coupling as well as differential-to-common-mode coupling that would otherwise occur between pairs of conductors when one of the conductor pair is driven with a differential signal. The present invention can be used to achieve both differential and common-mode crosstalk compensation without relying on conductor crossover techniques.

12 Claims, 1 Drawing Sheet

CROSSTALK COMPENSATION FOR ELECTRICAL CONNECTORS

BACKGROUND OF THE INVENTION

1. Field of the Invention

The present invention relates to electrical connectors, and, in particular, to such connectors designed to reduce crosstalk between adjacent conductors of different transmission paths.

2. Description of the Related Art

Near-end crosstalk refers to unwanted signals induced in one transmission path due to signals that are transmitted over one or more other transmission paths appearing at the end nearest to where the transmitted signals are injected. Near-end crosstalk often occurs when the wires and/or other conductors that form the various transmission paths are in close proximity to one another. Classic examples of near-end crosstalk are the signals induced during some voice transmissions that result in parties to one telephone call hearing the conversation of parties to another call. An example that would benefit from this invention is when high-speed data transmission is impaired due to coupling of unwanted signals from one path to another.

In a conventional telephony or data application, a signal is transmitted over a transmission path consisting of a pair of conductors, neither of which is grounded. To achieve a balanced signal, one voltage is applied to one of the conductors and another voltage having the same magnitude but opposite sign is applied to the other conductor. The difference between these two voltages is referred to as the differential voltage and their sum divided by two is referred to as the common mode voltage. When the two voltages are exactly equal in magnitude and opposite in sign, only a differential voltage will exist. A balanced signal is also referred to a differential signal. When such a differential signal is transmitted over one pair of conductors, two different types of crosstalk can be induced in an adjacent pair of conductors: differential crosstalk and common-mode crosstalk. Differential crosstalk refers to a differential or balanced signal that is induced in the adjacent pair, while common-mode crosstalk refers to a common-mode or an unbalanced signal that is induced in the adjacent pair.

Existing crosstalk compensation schemes for adjacent pairs of conductors in electrical connectors are designed to compensate for differential crosstalk on an idle pair induced (i.e., coupled) from an adjacent driven pair. In so doing, however, these schemes do not provide compensation for the differential-to-common-mode crosstalk between the driven pair and the idle pair.

FIG. 1 is a schematic drawing representing an example of an existing crosstalk compensation scheme designed to compensate for differential crosstalk between Pairs 2 and 3 in a four-pair modular mated plug/jack combination, such as those typically used for telephony or data applications (e.g., conforming to the T568-B wiring convention of the Telecommunications Industry Association (TIA) 568-A Standard). If, for example, Pair 3 is driven differentially, any coupled differential signal on Pair 2 is canceled out. Unfortunately, coupled common-mode signals on Pair 2 are not addressed by the compensation scheme of FIG. 1. The presence of this common-mode signal on Pair 2 degrades the crosstalk performance of the connector when it is deployed in a short link (known in the industry as short-link resonance). It also results in unacceptable levels of ingress and egress of electromagnetic interference. One way to compensate for this differential-to-common-mode coupling is to crossover both pairs of conductors, as shown in FIG. 2

FIG. 2 is a schematic drawing representing an example of a crosstalk compensation scheme designed to compensate for differential-to-common-mode coupling. While the compensation scheme of FIG. 2 effectively cancels out any coupled common-mode signals, it does not address differential-to-differential crosstalk.

What is needed is a crosstalk compensation scheme for connectors that addresses both differential-to-differential crosstalk as well as differential-to-common-mode crosstalk.

SUMMARY OF THE INVENTION

The present invention is directed to an electrical connector comprising two or more pairs of conductors, each adapted to carry a differential signal, wherein one or more coupling devices (e.g., capacitors) are connected between the conductors of different pairs to compensate for crosstalk between the different pairs.

BRIEF DESCRIPTION OF THE DRAWINGS

Other aspects, features, and advantages of the present invention will become more fully apparent from the following detailed description, the appended claims, and the accompanying drawings in which:

DETAILED DESCRIPTION

The present invention is directed to a crosstalk compensation scheme for connectors that addresses both differential-to-differential crosstalk as well as differential-to-common-mode crosstalk. According to the present invention, a connector having two or more pairs of conductors has coupling devices (e.g., capacitors) that are connected between conductors of different pairs. Values are selected for the coupling devices to provide compensation for differential-to-differential crosstalk as well as differential-to-common-mode crosstalk.

Figure 3:
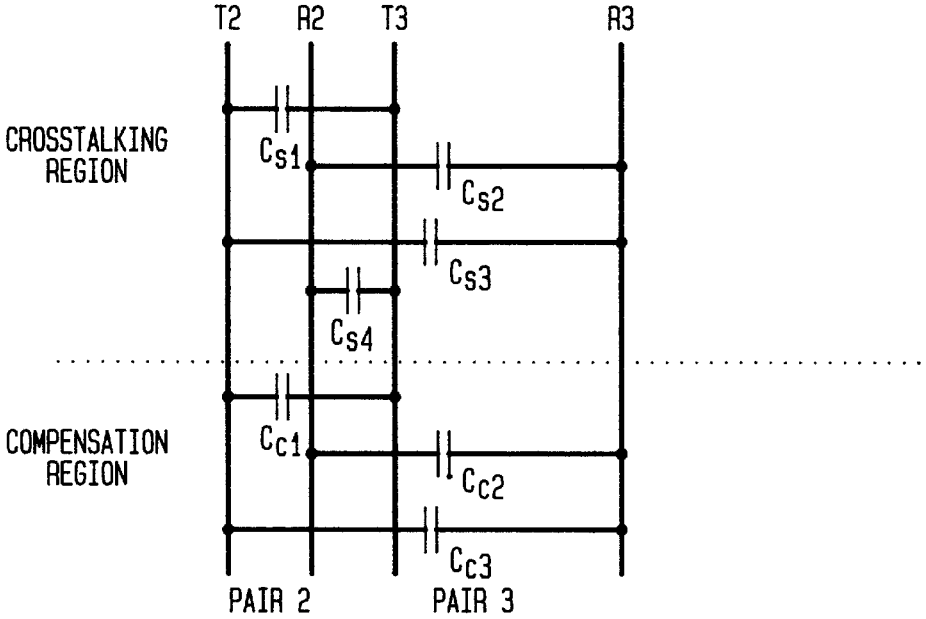
FIG. 3 is a schematic drawing representing a crosstalk compensation scheme, according to one embodiment of the present invention.

FIG. 3 is a schematic drawing representing a crosstalk compensation scheme for a modular plug/jack combination, according to one embodiment of the present invention. FIG. 3 shows the crosstalk compensation scheme between Pair 2 and Pair 3 of a four-pair connector. According to the present invention, capacitors are connected between conductors to form a compensation region for the connector. In particular, in the embodiment of FIG. 3, capacitor Cc1 is connected between T2 (the tip line of Pair 2) and T3 (the tip line of Pair 3), capacitor Cc2 is connected between R2 (the ring line of Pair 2) and R3 (the ring line of Pair 3), and capacitor Cc3 is connected between T2 and R3. In one possible implementation of the crosstalk compensation scheme of FIG. 3, capacitors Cc1, Cc2, and Cc3 are implemented by routing of traces of a printed wire board that is part of the jack of the plug/jack combination.

As represented in FIG. 3, the crosstalk coupling between Pair 2 and Pair 3, whether caused by capacitive or inductive mechanisms, can be characterized by four inherent capacitances Cs1, Cs2, Cs3, and Cs4 in a crosstalking region of the connector, the values of which are determined by the geometries of the conductors and the electrical properties of the medium material in the crosstalking region. These four capacitance values can be measured directly or inferred from measurements of actual crosstalk levels.

If the values of capacitors Cc1, Cc2, and Cc3 are chosen correctly, all differential-to-differential and differential-to-common-mode couplings between Pairs 2 and 3 will be canceled, regardless which of the two pairs is driven and which is idle.

The following analysis shows how to calculate the capacitor values for Pairs 2 and 3 of the modular plug/jack combination of FIG. 3 in order to achieve both differential and common-mode crosstalk compensation. The differential-to-differential and differential-to-common-mode crosstalk coupling effects in the crosstalking region can be represented by Equations (1)–(3) as follows:

$$Csu=-Cs1-Cs2+Cs3+Cs4 \quad (1)$$

$$Csb23=-Cs1+Cs2-Cs3+Cs4 \quad (2)$$

$$Csb32=Cs1-Cs2-Cs3+Cs4 \quad (3)$$

where:

Csu is the capacitive unbalance in the crosstalking region, responsible for differential-to-differential crosstalk between the two pairs;

Csb23 is the capacitive balance in the crosstalking region, responsible for differential-to-common-mode crosstalk when Pair 2 is driven and Pair 3 is idle; and Csb32 is the capacitive balance in the crosstalking region, responsible for differential-to-common-mode crosstalk when Pair 3 is driven and Pair 2 is idle.

The term "capacitive unbalance" describes the total capacitive coupling between two pairs contributing to differential-to-differential crosstalk, and the term "capacitive balance" describes the total capacitive coupling between two pairs contributing to differential-to-common-mode crosstalk. For total differential-to-differential and differential-to-common mode crosstalk cancellation, the three capacitors Ccl, Cc2, and Cc3 should be chosen to produce capacitive unbalances and balances equal to and opposite in polarity to those in the crosstalking region, as expressed in Equations (4)–(6) as follows:

$$-Cc1-Cc2+Cc3=-Csu \quad (4)$$

$$-Cc1+Cc2-Cc3=-Csb23 \quad (5)$$

$$Cc1-Cc2-Cc3=-Csb32 \quad (6)$$

Solving Equations (4)–(6) for Cc1, Cc2, and Cc3 yields Equations (7)–(9) as follows:

$$Cc1=\frac{Csu+Csb23}{2} \quad (7)$$

$$Cc2=\frac{Csu+Csb32}{2} \quad (8)$$

$$Cc3=\frac{Csb23+Csb32}{2} \quad (9)$$

Substituting for Csu, Csb23, and Csb32 from Equations (1)–(3) into Equations (7)–(9) yields Equations (10)–(12) as follows:

$$Cc1=Cs4-Cs1 \quad (10)$$

$$Cc2=Cs4-Cs2 \quad (11)$$

$$Cc3=Cs4-Cs3 \quad (12)$$

As indicated by Equations (10)–(12), knowing Cs1, Cs2, Cs3, and Cs4, the values of Cc1, Cc2, and Cc3 that will produce total cancellation of all differential-to-differential and differential-to-common-mode crosstalk in the combined plug/jack combination of FIG. 3 can be calculated. The same can be achieved by inferring Csu, Csb23, and Csb32 from differential-to-differential and differential-to-common-mode crosstalk measurements performed for the crosstalking region.

When three capacitors are used to provide crosstalk compensation, there is a unique solution for a given set of inherent connector capacitances. In an alternative embodiment, four capacitors can be used (e.g., adding a capacitor Cc4 between R2 and T3). In this case, a degree of freedom is added to the selection of capacitor values that will achieve the desired result of crosstalk compensation. It will also be understood that, in theory, the present invention can be implemented using any type of coupling device (i.e., either capacitors or inductive transformers or both). Furthermore, these devices may be discrete or integral parts of printed wiring boards, lead-frames, or stamped metal conductors.

The above derivation for the values for capacitors Cc1, Cc2, and Cc3 is based on the crosstalk between only Pairs 2 and 3 of a four-pair connector. Those skilled in the art will understand that the same principles can be extended to derive capacitor values that will compensate for crosstalk between all pairs of any multi-pair plug/jack combination. In general, the problem is one of solving multiple linear equations of multiple unknowns.

Figure 1:
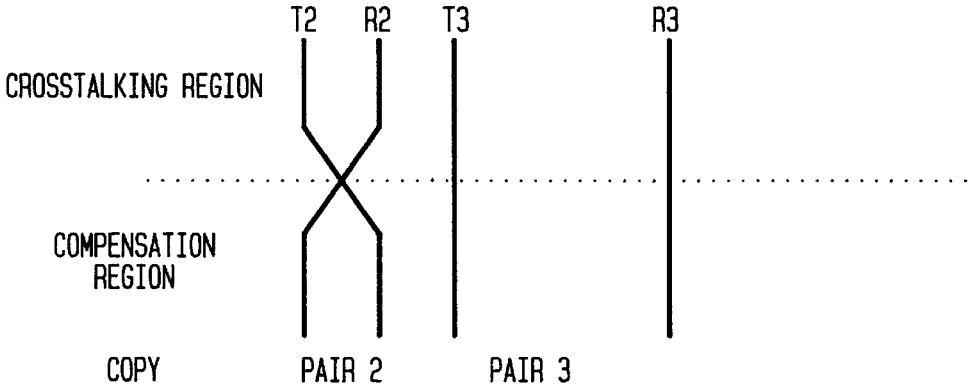
FIG. 1 is a schematic drawing representing an example of an existing crosstalk compensation scheme designed to compensate for differential-to-differential coupling.
Figure 2:
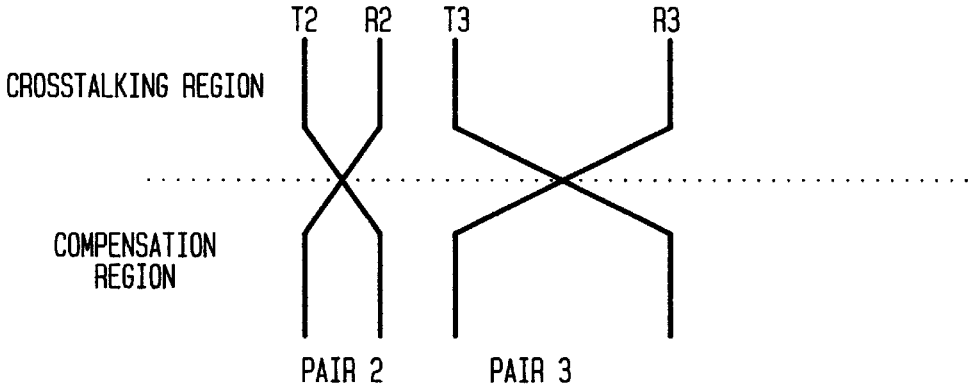
FIG. 2 is a schematic drawing representing an example of a crosstalk compensation scheme designed to compensate for differential-to-common-mode coupling.

One of the advantages of the present invention is that it eliminates the need for crossover of conductors. This may reduce costs of manufacturing at least those portions of plug/jack combinations of the present invention when compared with combinations that employ conventional crossover compensation schemes, such as those of FIGS. 1 and 2. Nevertheless, the present invention can be implemented in situations in which one or more pairs of conductors do crossover. In such situations, one or more of the equations in the above derivation will be changed to reflect the different types of capacitive coupling between pairs of conductors. In FIG. 3, the present invention is implemented in the context of a modular plug/jack combination, such as may be implemented with jack shown in FIG. 4 having printed wire board 402. It will be understood that the present invention can be generalized to apply to crosstalk compensation for any two balanced signal pairs that are adjacent to one another in any type of mating connector.

The use of figure reference labels in the claims is intended to identify one or more possible embodiments of the claimed subject matter in order to facilitate the interpretation of the claims. Such labeling is not to be construed as necessarily limiting the scope of those claims to the embodiments shown in the corresponding figures.

It will be further understood that various changes in the details, materials, and arrangements of the parts which have been described and illustrated in order to explain the nature of this invention may be made by those skilled in the art without departing from the principle and scope of the invention as expressed in the following claims.

What is claimed is:

1. An electrical connector comprising two or more pairs of conductors, each adapted to carry a differential signal, wherein at least three coupling devices are connected between the conductors of one or more pairs of mutually unbalanced pairs to compensate for crosstalk between the different pairs, wherein one of the three coupling devices is connected between the farthest conductors between the mutually unbalanced pairs.

2. The invention of claim 1, wherein the coupling devices are capacitors.

3. The invention of claim 1, wherein:

a first pair of conductors comprises a first conductor and a second conductor;

a second pair of conductors comprises a third conductor and a fourth conductor;

a first coupling device is connected between the first conductor and the third conductor;

a second coupling device is connected between the second conductor and the fourth conductor; and a third coupling device is connected between the first conductor and the fourth conductor, wherein the first and fourth conductors are the farthest conductors between the first and second pairs of conductors.

4. The invention of claim 3, wherein the first, second, and third coupling devices are capacitors.

5. The invention of claim 3, wherein the second and third conductors are located between the first and fourth conductors.

6. The invention of claim 3, further comprising a fourth coupling device connected between the second conductor and the third conductor.

7. The invention of claim 3, wherein the first, second, and third coupling devices are inductive transformers.

8. The invention of claim 1, further comprising a printed wire board implementing the coupling devices.

9. The invention of claim 1, wherein the pairs of conductors do riot crossover.

10. The invention of claim 1, wherein the connector is a jack.

11. The invention of claim 1, wherein the coupling devices are discrete or integral parts of printed wire boards, lead frames, or stamped metal conductors.

12. The invention of claim 1, wherein: the coupling devices are capacitors;

a first pair of conductors comprises a first conductor and a second conductor;

a second pair of conductors comprises a third conductor and a fourth conductor;

the second and third conductors are located between the first and fourth conductors;

a first capacitor is connected between the first conductor and the third conductor;

a second capacitor is connected between the second conductor and the fourth conductor;

a third capacitor is connected between the first conductor and the fourth conductor;

the first, second, and third capacitors are implemented on a printed wire board; and the first and second pairs of conductors do not crossover.

* * * * *